US006844861B2

(12) United States Patent
Peterson

(10) Patent No.: US 6,844,861 B2
(45) Date of Patent: Jan. 18, 2005

(54) METHOD OF FABRICATING WAVEGUIDE CHANNELS

(76) Inventor: Stig Anders Peterson, Hokmark 1585, S-930 10 Lovanger (SE)

( * ) Notice: Subject to any disclaimer, the term of this patent is extended or adjusted under 35 U.S.C. 154(b) by 0 days.

(21) Appl. No.: 10/275,445

(22) PCT Filed: May 7, 2001

(86) PCT No.: PCT/SE01/00991

§ 371 (c)(1),
(2), (4) Date: May 15, 2003

(87) PCT Pub. No.: WO01/86751

PCT Pub. Date: Nov. 15, 2001

(65) Prior Publication Data

US 2003/0179146 A1 Sep. 25, 2003

(30) Foreign Application Priority Data

May 5, 2000 (SE) ..... 0001674

(51) Int. Cl.[7] ..... H01Q 13/00
(52) U.S. Cl. ..... 343/776; 333/248; 29/600
(58) Field of Search ..... 343/772, 775, 343/776, 779; 333/248; 29/600

(56) References Cited

U.S. PATENT DOCUMENTS

| | | | | |
|---|---|---|---|---|
| 2,900,706 A | | 8/1959 | Mariner et al. | |
| 5,168,542 A | * | 12/1992 | Chakravorty et al. | 385/132 |
| 5,448,821 A | * | 9/1995 | Bois | 29/600 |
| 5,818,395 A | * | 10/1998 | Wolcott et al. | 343/753 |

FOREIGN PATENT DOCUMENTS

| | | | |
|---|---|---|---|
| JP | 8-195605 | 11/1996 | H01P/3/14 |
| WO | wo 9960666 | 11/1999 | H01Q/15/06 |

* cited by examiner

*Primary Examiner*—Hoang V. Nguyen
(74) *Attorney, Agent, or Firm*—Blakely Sokoloff Taylor & Zafman

(57) ABSTRACT

When manufacturing waveguides, for example densely located waveguide channels, for electromagnetic waves such as microwaves, the channels are produced from rod-shaped bodies (1) of a material permeable to the waves and non significantly attenuating the waves. The bodies (1) can for example project from a base plate (3) and their side surfaces are coated with electrically conducting material but not their free end surfaces (5). The interior of the bodies form the waveguide channels, which have their walls formed from the layer of electrically conducting material. By giving the rod-shaped bodies suitable shapes for example an antenna side or half of a waveguide antenna can be manufactured. The rod-shaped bodies can before applying the electrically conducting material be coated with one or several layers of non-attenuating and non-conducting lacquer filling pores and smoothing the surface of the bodies. Thereby, the layer of electrically conducting material obtains a smooth transition surface to the material of the bodies giving the channels good waveguide characteristics. If the material used in the bodies has a strong surface porosity, the channels formed from the rod-shaped bodies become strongly attenuating to the electromagnetic waves. A set of such bodies located at the sides of each other and having suitable dimensions of the bodies gives an element working strongly attenuating to the electromagnetic waves.

24 Claims, 5 Drawing Sheets

Fig. 4
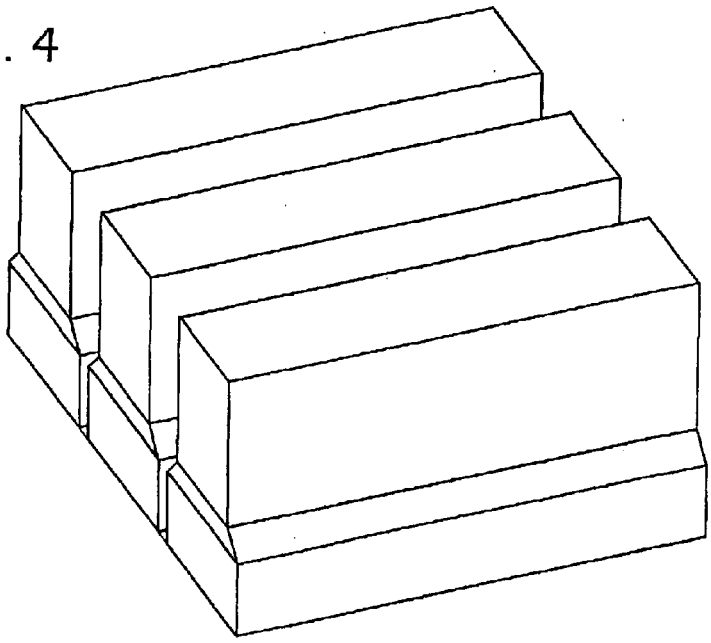
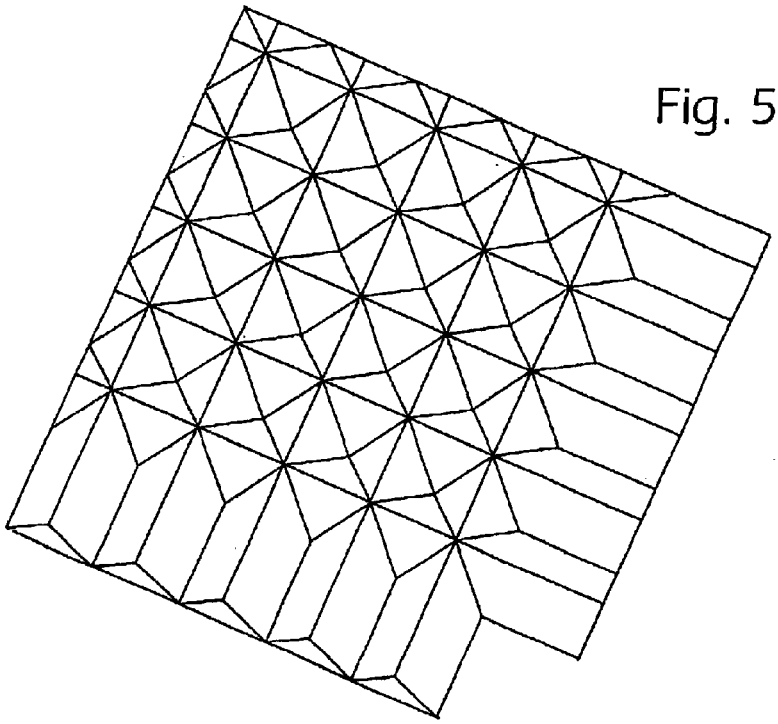
Fig. 5

METHOD OF FABRICATING WAVEGUIDE CHANNELS

The present patent application is a non-provisional application of International Application No. PCT/SE01/00991, filed May 7, 2001.

TECHNICAL FIELD

The present application relates to a method of manufacturing waveguide channels for microwaves, in particular waveguide channels arranged closely at or at the sides of each other, and furthermore a method of manufacturing elements for attenuating microwaves.

BACKGROUND

In waveguide antennas for receiving and transmitting electromagnetic radiation having frequencies in for example the GHz range the largest possible portion of the surface of the antennas should consist of open channels that are densely packed, i.e. are located closely at or at the sides of each other. This results in that the walls between the channels become long and narrow. Manufacturing such long channels is impossible using the technology which at present is available for mass production. Waveguide antennas having such channels are for example disclosed in the published International patent application WO 94/11920.

Waveguide channels for microwaves are generally often made as metal tubes having accurate internal dimensions. Due to the required high accuracy the manufacture is costly and such channels therefore have high prices.

SUMMARY OF THE INVENTION

It is an object of the invention to provide a low-cost method of manufacturing waveguiding channels for electromagnetic waves such as microwaves.

It is another object of the invention to provide a simple method of manufacturing panels attenuating electromagnetic waves such as microwaves.

Thus, a body can be made from a material permeable for electromagnetic waves and thereafter be coated with electrically conducting material such as being metallized on some of its surfaces. For a suitable shape of the body and suitably selected metallized surfaces thereof then the interior of the body forms a waveguiding channel having wall surfaces constituted by the interior surfaces of the electrically conducting metal layer. The body can be given a suitable geometric shape so that different waveguiding devices can be obtained such as simple separate channels, waveguide lenses and filters.

If the material of the body has a surface porosity, suitably the surfaces of the body are first coated with a surface smoothing or evening material that does not significantly affect the propagation of the electromagnetic waves. This material can either be permanent or made to evaporate after coating with the electrically conducting material.

The surface porosity can also be employed for manufacturing a structure attenuating electromagnetic waves, in particular microwaves. The a plate shaped body can be produced having cut-outs or recesses made in a first large surface of the body. Thereafter the first large surface is coated with electrically conducting material for forming an electrically conducting surface layer having a rough lower surface at the continuation to the permeable or non-attenuating material having a surface porosity. The interior surface of the conducting material obtains such a roughness that it works strongly attenuating to waves incoming to the second, opposite large surface of the body. The cut-outs or recesses are suitably given such shapes that between them projecting rods are formed, the dimensions of the cross-sections of which somewhere are larger than half the wavelength of the electromagnetic waves in the material having a surface porosity. In addition to the attenuating effect resulting from the rough lower surface the waves are also hindered because of the dimensions of the cross-sections of the channels formed in the rods.

BRIEF DESCRIPTION OF THE DRAWINGS

The invention will now be described by way of non limiting embodiments with reference to the accompanying drawings in which:

FIG. 4 is a perspective view of waveguides placed at the side of each other having special cross-sections, and FIG. 5 is a view of an attenuating panel.

DETAILED DESCRIPTION

Figure 1:
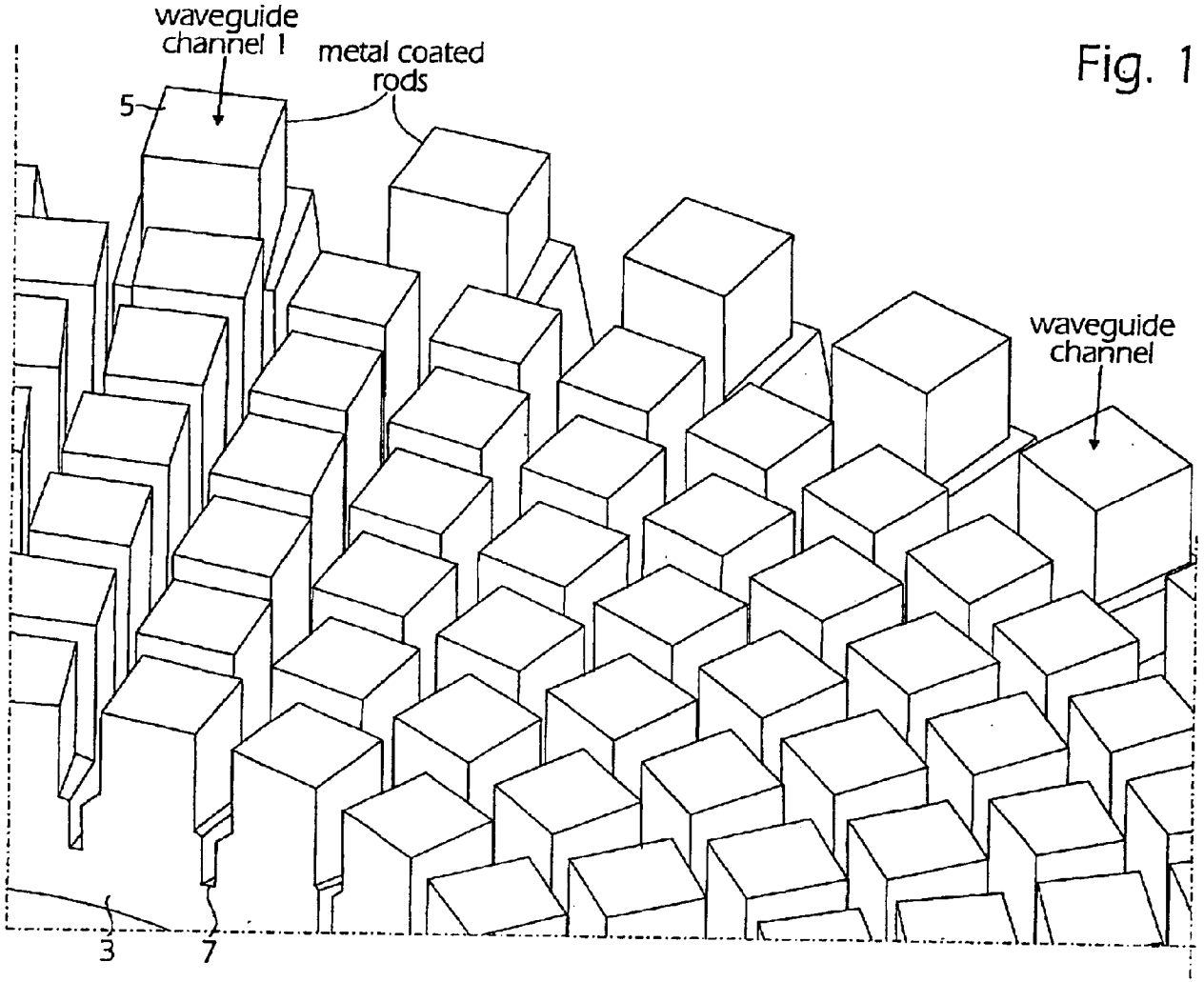
FIG. 1 is a perspective view of a portion of a half of a waveguide antenna.
Figure 2A:
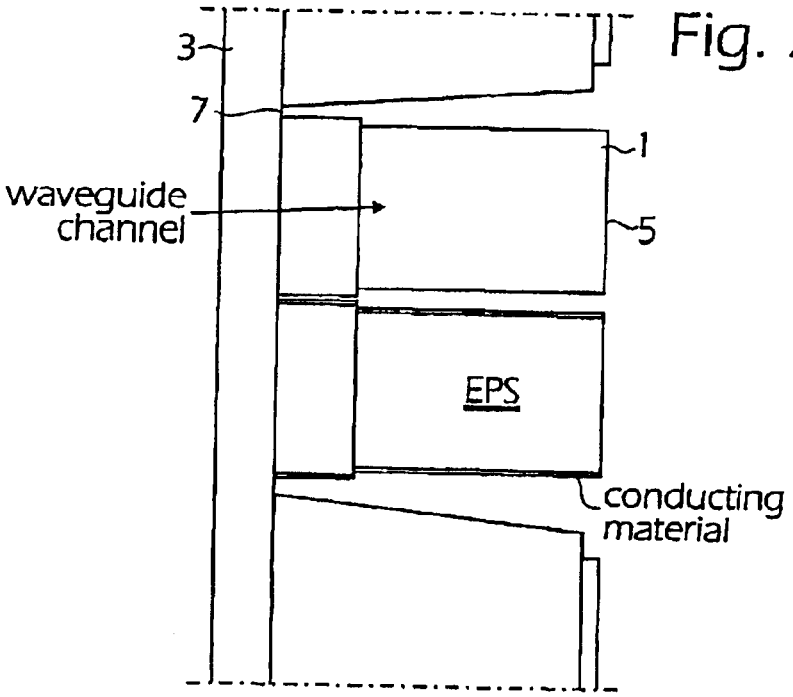
FIG. 2*a* is a cross-sectional view of a portion of a waveguide antenna.

Materials exist which have such a low attenuation of electromagnetic waves that they can approximately be considered as air in spite of the fact that they in other respects have characteristics of solids. An example of such a material is EPS (Expanded PolyStyrene) that has an attenuation coefficient smaller than 0.1 dB/dm. This material can be easily used for manufacturing bodies having very varying shapes. In FIG. 1 is in a perspective view shown a portion of a waveguide antenna made from such a material having an insignificant attenuation for electromagnetic radiation, see also the part cross-sectional view of FIG. 2*a*. The waveguide antenna is formed from rods 1 that project to one side from a for example flat base plate 3 keeping the antenna together to form one unit. The rods 1 are on their side surfaces coated with an electrically conducting layer, see the description hereinafter. The end surfaces 5 of the rods have no such coating but in contrast there is a conducting coating on the free surface portions 7 of the base plate which are located between the rods 1. Thereby the interior of the rods, i.e. the regions inside them, interior of the electrically conducting surface layers, waveguiding channels. The rods 1 have furthermore geometric shapes adapted to the refracting function of the waveguide antenna so that the waveguiding channels together give the desired lens function. The rods can thus be tapering in a direction away from the base plate 3, as seen in the figures.

Figure 2B:
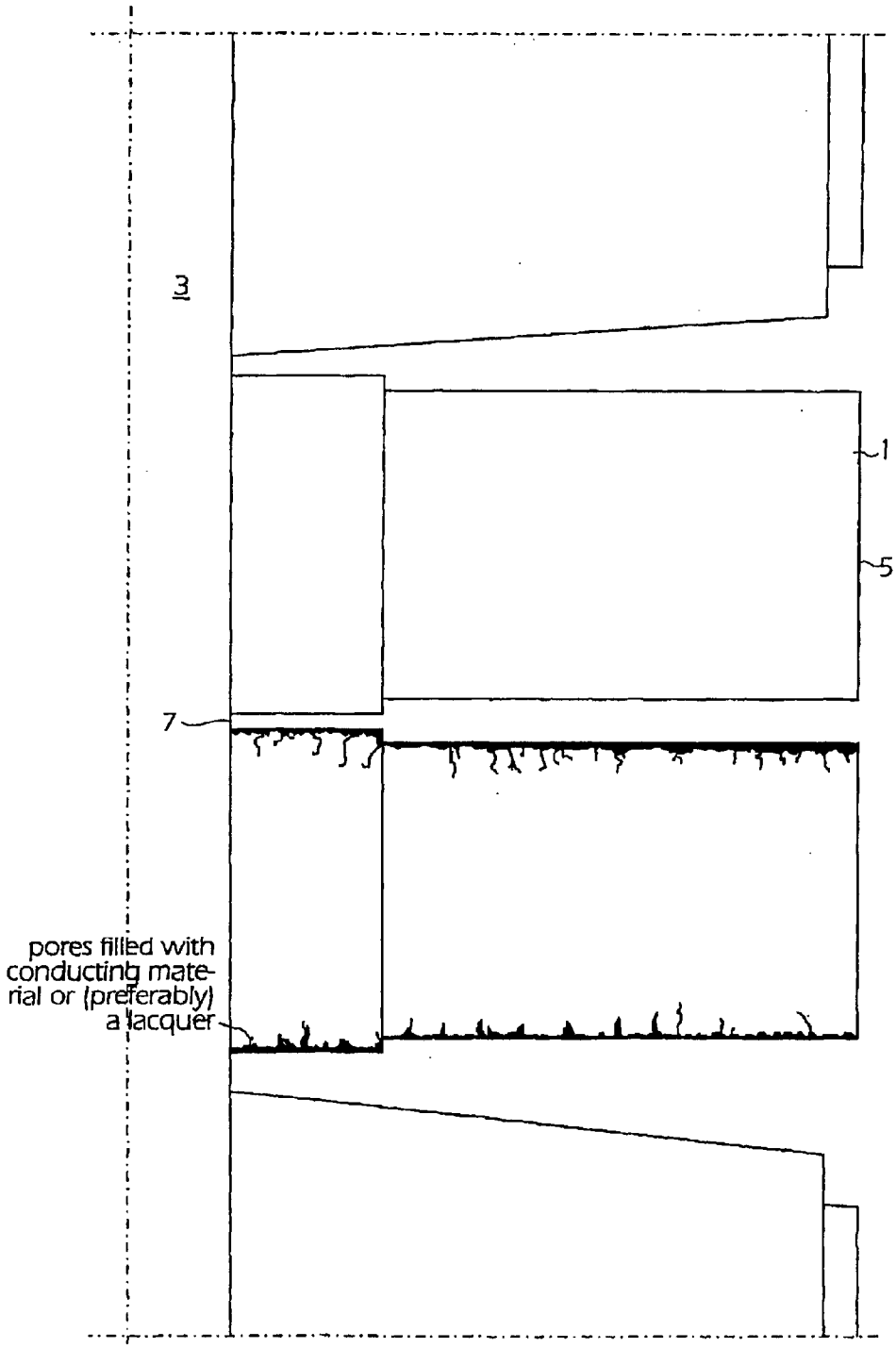
FIG. 2*b* is a cross-sectional view corresponding to FIG. 2*a* in a larger scale.

When using the above mentioned material EPS and similar expanded polymer materials such as expanded polyurethane for manufacturing waveguiding channels according to the description above, bodies of the material can be first produced by expansion caused by a suitable beating of an adapted amount of non-expanded material placed in a close mould cavity. Then the produced bodies can be coated with an electrically conducting paint for producing the conducting surface layer. The material of bodies produced in that way is however at the same time often porous, and if bodies made therefrom are directly coated with a conducting paint, pores 9 at the surface of the bodies are filled with the conducting paint. These pores can extend a good distance into the expanded polymer bodies, see FIG. 2*b*. A surface having such pores filled with an electrically conducting material is rough and attenuates electromagnetic wave propagating inside the bodies. The result is—particularly in the case where the bodies of the material contains pores extending deeply from the surface—that the interior of the bodies do not obtain any waveguiding properties for electromagnetic waves and thus do not work as waveguides due to the fact that the interior of the bodies have metal walls which are strongly attenuating for electromagnetic waves inside the bodies.

To avoid such attenuating effects the bodies of the structural material used, for example EPS, are first coated with one or several layers of an electrically non-conducting lacquer that does not work significantly attenuating for electromagnetic waves and that both fills the surfaces pores and smooths the surface of the bodies. Thereafter the electrically conducting lacquer is applied and it then forms a completely smooth outer-most layer on the bodies having in particular a smooth interior surface where this lacquer continues into the next underlying layer of non attenuating lacquer. The layer of electrically non-conducting lacquer can be applied to the bodies by dipping or immersing or by inmould-methods.

Alternatively the bodies can be first coated with an electrically non conducting liquid that also both fills surface pores of the bodies and smooths the surface of the bodies. The liquid can be selected so that it prevents the electrically conducting lacquer from penetrating into the bodies and so that it is evaporated or evaporates after applying the electrically conducting lacquer. Such a liquid can include a liquid, for example water, that is completely non-miscible with the electrically conducting lacquer.

Figure 3:
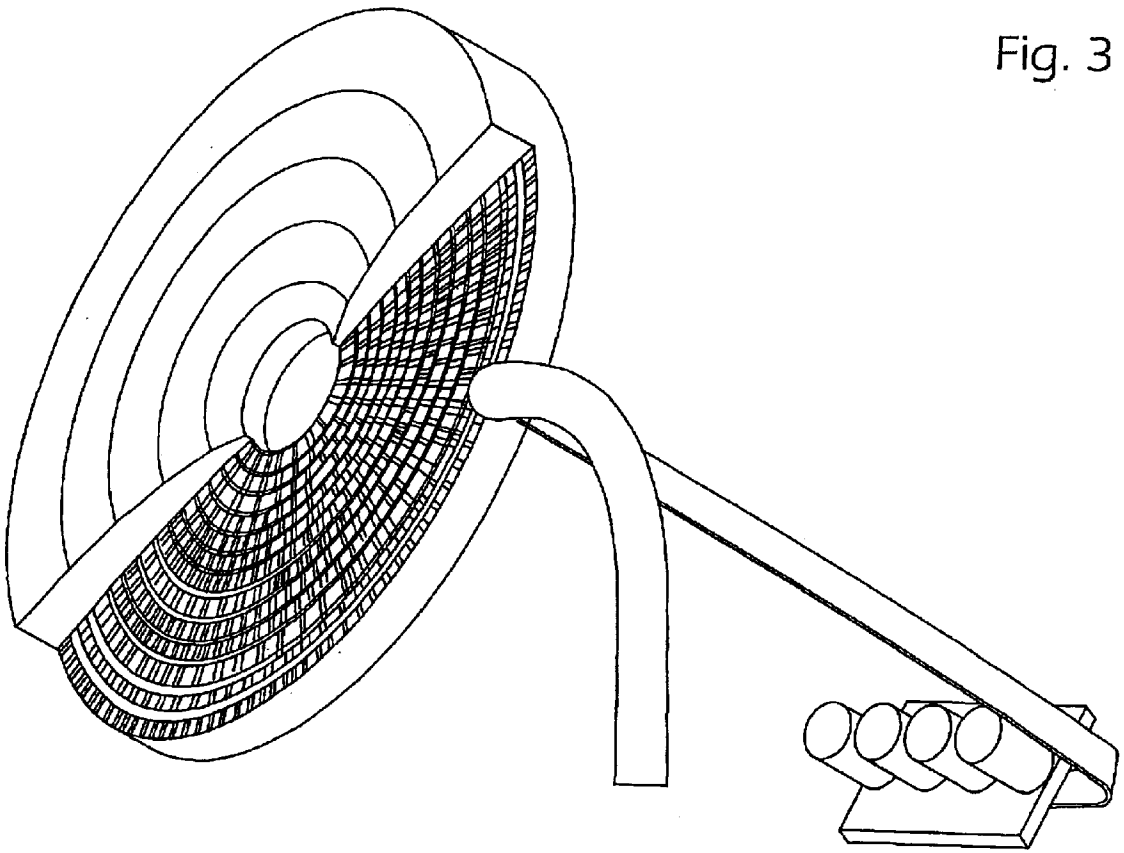
FIG. 3 is a perspective view of a waveguide antenna in which half of an antenna side is removed.

To mass manufacture waveguiding structures for for example antenna function often several moulds are required, for example one mould for one side and another one for the opposite side. In FIG. 3 a waveguide antenna is shown in which half of an antenna side is removed. Using this manufacturing method it is possible to make channels having adjacent sides in common and a more narrow interior portion. In such a case, as has been described above with reference to FIGS. 1 and 2, the sides of the rods 1, which then correspond to portions of waveguide channels, and the common surfaces 7 between two rods are coated with conducting material but not the surface 5, at which two halves are to be joined to each other. Thereafter opposite surface of the antenna sides are joined to each other and continuous channels having optimized entrance and exit sides are obtained.

Devices having different kinds of waveguiding channels can be manufactured. In FIG. 4 for example waveguides are shown that are obtained from rods located at the sides of each other and having T-shaped cross-sections. The rods 1 generally have different shapes depending on the intended application. Thus they can have substantially square cross-sections, such as for waveguide channels for general use, or rectangular cross-sections, such as for waveguide lenses, filters and plan/circular-rotating arrays intended for only one of the polarisations of an electromagnetic wave.

Reflecting waveguides, not shown, can be manufactured by first producing suitable rod-shaped bodies according to the description above and that then one of the end surfaces of the bodies are coated with electrically conducting material in addition to the side surfaces. This gives a reflection, so that an incoming electromagnetic wave first enters the channels formed by the bodies from the uncoated ends of the rods and then turns and exits the same channels.

If suitable rod-shaped bodies are first produced according to the description above and then only two opposite side surfaces of the bodies are coated with electrically conducting surface layers, lenses or filters formed from parallel plates can be obtained which are intended for electromagnetic waves having a single polarisation.

The rods should generally have cross-sectional dimensions larger than half the largest wavelength for which their waveguiding functions are to be utilized for amplifying or filtering.

Simple waveguide channels, not shown, can be manufactured in the similar way. A simple straight body having for example a uniform rectangular cross-section is first produced. The body is bent to the desired shape and is then coated with one or several layers of electrically non-conducting lacquers, for example of an epoxy polymer, and finally with a layer of electrically conducting material. The coating with lacquers and in particular with a polymer material results in that the body will permanently maintain its shape.

The property of attenuating electronmagnetic waves of bodies of the mentioned materials directly coated with an electrically conducting lacquer can be used for manufacturing attenuating surface panels. An example of such a panel is shown in FIG. 5 and includes a plurality of conically shaped or pyramidal recesses located at the sides of each other and formed in one of the large surfaces of an otherwise flat body. The recesses are thus directly coated with electrically conducting paint. The panel works, for a suitable shape of the recesses and provided that the lacquer has well penetrated into the surface pores of the panel, attenuating to electromagnetic waves which are incident to the opposite large surface of the panel that can be substantially flat and is not coated with an electrically conducting layer. If a closed space is lagged with such panels, the flat surfaces of the panels directed to the interior of the space, a space is obtained in which possible electromagnetic waves are efficiently attenuated. The portions of the recesses located between the panels that correspond to the waveguide channels according to the description above should generally somewhere, for example at their entrances or at their central portions, have cross-sectional dimensions larger than half the largest wavelength for which their attenuating function is to be used.

What is claimed is:

1. A method of manufacturing a waveguide channel for electromagnetic waves comprising the steps of:

producing a body from a material that is substantially permeable by and/or does not significantly attenuate the electromagnetic waves, wherein said body is produced in the desired shape of the waveguide channel;

coating the exterior surfaces of the body with at least one layer of electrically non-conducting lacquer or paint that is substantially permeable by and/or does not significantly attenuate the electromagnetic waves and that fills pores and smoothes the surfaces of the body; and then applying to the coated body a further coating of electrically conducting material.

2. The method of claim 1, wherein said at least one layer of electrically non-conducting lacquer or paint is applied using dipping.

3. The method of claim 1, wherein said at least one layer of electrically non-conducting lacquer or paint is applied using an in-mold process.

4. The method of claim 1, wherein the body comprises a plurality of rod-shaped elements located near to each other, each of said plurality of rod-shaped elements being given the shape of a waveguide channel for the electromagnetic waves.

5. The method of claim 1, wherein the body is produced as a plurality of rod-shaped elements located near to each other and projecting from a base plate.

6. The method of claim 1, wherein the body is produced from an expanded polymer material.

7. The method of claim 1, wherein the body is produced from expanded polystyrene.

8. The method of claim 1, wherein the body is produced from a polymer material having a porous surface.

9. The method of claim 1, wherein a plurality of coated bodies are separately produced, each forming a waveguide channel for electromagnetic waves, and thereafter said coated bodies are joined to each other.

10. The method of claim 1, wherein side surfaces and only one end surface of the body are coated with electrically conducting material, so that incoming electromagnetic waves first pass into the channel formed by the coated body through the uncoated end surface and are then reflected by the coated end and pass out of the same channel through the uncoated end surface.

11. A method of manufacturing a waveguide channel for electromagnetic waves comprising the steps of:

producing a body from a material that is substantially permeable by and/or does not significantly attenuate the electromagnetic waves, wherein said body is produced in the desired shape of the waveguide channel;

applying to the exterior surfaces of the body at least one layer of an electrically non-conducting liquid that fills pores and smoothes the surfaces of the body; and applying a coating of electrically-conducting material on top of said at least one layer of said electrically non-conducting liquid, where the electrically non-conducting liquid is selected to prevent the electrically conducting material from penetrating into the body and the electrically non-conducting liquid is evaporated after applying the coating of said electrically conducting material.

12. The method of claim 11, wherein the body comprises a plurality of rod-shaped elements located near to each other, each of said plurality of rod-shaped elements being given the shape of a waveguide channel for the electromagnetic waves.

13. The method of claim 11, wherein the body is produced as a plurality of rod-shaped elements located near to each other and projecting from a base plate.

14. The method of claim 11, wherein the body is produced from an expanded polymer material.

15. The method of claim 11, wherein the body is produced from expanded polystyrene.

16. The method of claim 11, wherein the body is produced from a polymer material having a porous surface.

17. The method of claim 11, wherein a plurality of coated bodies are separately produced, each forming a waveguide channel for the electromagnetic waves, and thereafter said coated bodies are joined to each other.

18. The method of claim 11, wherein side surfaces and only one end surface of the body are coated with electrically conducting material, so that incoming electromagnetic waves first pass into the channel formed by the coated body through the uncoated end surface and are then reflected by the coated end and pass out of the same channel through the uncoated end surface.

19. A method of manufacturing waveguide channels for electromagnetic waves comprising the steps of:

producing a plurality of rod-shaped elements located near to each other and projecting from a base plate;

forming the rod-shaped elements into shapes corresponding to the shapes of the waveguide channels;

coating the exterior surfaces of the rod-shaped elements with electrically conducting material; and producing the rod-shaped elements and the base plate from a material that is substantially permeable by and/or does not significantly attenuate the electromagnetic waves.

20. A method of manufacturing a waveguide channel for electromagnetic waves comprising the steps of:

producing a body from a material that is substantially permeable by and/or does not significantly attenuate the electromagnetic waves, wherein said body is produced in the desired shape of the waveguide channel; and coating side surfaces and only one end surface of the body with electrically conducting material, so that incoming electromagnetic waves first pass into the channel formed by the coated body through the uncoated end surface, then are reflected by the coated end surface and pass out of the same channel through the uncoated end surface.

21. A method of manufacturing a waveguide element for electromagnetic waves comprising the steps of:

producing a body from a material that is substantially permeable by and/or does not significantly attenuate the electromagnetic waves, wherein said body is produced in the desired shape of the waveguide channel for electromagnetic waves, and coating only two opposite side surfaces of the body with electrically conducting material in order to produce lenses or filters intended for only a single polarization of the electromagnetic waves.

22. A method of manufacturing a structure for attenuating electromagnetic waves comprising the steps of:

forming a plate-shaped body from a material that is substantially permeable by and/or does not significantly attenuate the electromagnetic waves, said body having at least one large surface including cut-outs or recesses made therein, where said large surface is porous; and coating the large porous surface with electrically conducting material to form an electrically-conducting layer with a rough surface at the interface between the electrically-conducting layer and the plate-shaped body, such that said rough surface attenuates electromagnetic waves that strike it.

23. The method of claim 22, wherein cut-outs or recesses in the shape of projecting rods are formed in the plate-shaped body, said cut-outs or recesses having cross-sectional dimensions larger than half the wavelength of the electromagnetic waves, so that further attenuation of the electromagnetic waves is achieved by the cross-sectional dimensions of the cut-outs or recesses.

24. A structure for attenuating electromagnetic waves comprising a plate-shaped body formed out of a material with a porous surface that is substantially permeable by and/or does not significantly attenuate the electromagnetic waves, wherein:

the plate-shaped body has cut-outs or recesses made in a first large surface; and the first large surface is coated with an electrically-conducting material that penetrates into surface pores of the plate-shaped body and thereby acquires a rough surface at the interface between the electrically-conducting material and the plate-shaped body;

so that for electromagnetic waves incoming to a second surface opposite to the first large surface of the plate-shaped body, the rough lower surface of the electrically-conducting material attenuates said electromagnetic waves.

* * * * *

UNITED STATES PATENT AND TRADEMARK OFFICE

CERTIFICATE OF CORRECTION

PATENT NO. : 6,844,861 B2
DATED : January 18, 2005
INVENTOR(S) : Peterson

It is certified that error appears in the above-identified patent and that said Letters Patent is hereby corrected as shown below:

Title page,
Item [56], References Cited, FOREIGN PATENT DOCUMENTS, please delete "wo 9960666" and insert -- 9960666 --.

Signed and Sealed this

Second Day of August, 2005

JON W. DUDAS
*Director of the United States Patent and Trademark Office*